US006825453B2

(12) United States Patent
Kang et al.

(10) Patent No.: US 6,825,453 B2
(45) Date of Patent: Nov. 30, 2004

(54) MICROWAVE OVEN AND METHOD FOR CONTROLLING THE SAME

(75) Inventors: Kwang-Seok Kang, Suwon (KR); Yong-Woon Han, Kunpo (KR); Chul Kim, Anyang (KR)

(73) Assignee: Samsung Electronics Co., Ltd., Suwon (KR)

( * ) Notice: Subject to any disclaimer, the term of this patent is extended or adjusted under 35 U.S.C. 154(b) by 513 days.

(21) Appl. No.: 09/981,836

(22) Filed: Oct. 19, 2001

(65) Prior Publication Data

US 2003/0010776 A1 Jan. 16, 2003

(30) Foreign Application Priority Data

Jul. 11, 2001 (KR) ..... 01-41457

(51) Int. Cl.[7] ..... H05B 6/68

(52) U.S. Cl. ..... 219/702; 219/714; 219/518; 219/506; 219/758; 99/325

(58) Field of Search ..... 219/702, 704, 219/705, 709, 711, 714, 506, 518, 758; 99/451, 325

(56) References Cited

U.S. PATENT DOCUMENTS 6,138,555 A * 10/2000 Hata ..... 99/451

FOREIGN PATENT DOCUMENTS

| | | | |
|---|---|---|---|
| JP | 2-33530 | * 2/1990 | ..... 219/758 |
| JP | 3-251619 | * 11/1991 | ..... 219/518 |
| JP | 5-26449 | * 2/1993 | ..... 219/716 |
| JP | 6-180120 | * 6/1994 | ..... 126/42 |
| JP | 6-300280 | * 10/1994 | |

* cited by examiner

*Primary Examiner*—Philip H. Leung
(74) *Attorney, Agent, or Firm*—Robert E. Bushnell, Esq.

(57) ABSTRACT

Disclosed herein is a microwave oven and method for controlling the same. The microwave oven is used to heat and cook food using high frequency waves generated by high frequency generating means provided in an oven body. The microwave oven includes body sensing means for detecting the presence of a user in a sensing area extended over a certain area in front of the oven body, first operating means for operating the high frequency generating means, and control means for controlling the first operating means to selectively start, stop and resume the operation of the high frequency wave generating means according to the presence of a user in the sensing area.

10 Claims, 6 Drawing Sheets

START
APPLY POWER
S10
TURN ON SENSOR
S20
S30
S31
DOOR OPENED?
YES
NO
S32
BODY SENSED?
NO
YES
S33
TURN ON LAMP
S34
TURN OFF LAMP
NO
COOKING START SIGNAL INPUTTED?
S41
YES
YES
BODY SENSED?
S42
NO
OPERATE MAGNETRON
S43
NO
BODY SENSED?
S44
YES
S40
STOP MAGNETRON
S45
NO
COOKING TERMINATED?
S46
S50
YES
S51
DOOR OPENED?
NO
YES
S52
BODY SENSED?
NO
YES
TURN OFF LAMP
S54
S53
TURN ON LAMP
RETURN

MICROWAVE OVEN AND METHOD FOR CONTROLLING THE SAME

CLAIM OF PRIORITY

This application makes reference to, incorporates the same herein, and claims all benefits accruing under 35 U.S.C. §119 from my application entitled MICROWAVE OVEN AND METHOD THEREOF filed with the Korean Industrial Property Office on Jul. 11, 2001 and there duly assigned Ser. No. 2001-41457.

BACKGROUND OF THE INVENTION

1. Field of the Invention

The present invention relates to a microwave oven and method for controlling the same, in which the presence of a user in a sensing area around the microwave oven is sensed, and the generation of high frequency waves and the illumination of a cooking chamber are controlled according to the presence of a user in the sensing area.

2. Description of the Conventional Art

In general, a microwave oven is an electronic appliance for heating and cooking food by irradiating high frequency microwaves to a sealed cavity wherein food is contained. Such a microwave oven generally includes a high voltage transformer and a magnetron. A control panel comprised of input and display parts is mounted on the front surface of an oven body to be conveniently manipulated by a user.

Referring to FIG. 5, the interior of an oven body 1 is partitioned into a machine chamber and a cooling chamber 4. A variety of electric devices including the machine chamber, a lamp 7, a cooling fan 8, a magnetron MGT, a high voltage transformer HVT, a high voltage condenser HVC, etc. are positioned in the machine chamber 2. A rotary tray 5 is mounted on the bottom of the cooling chamber 4 to hold food, and a door 3 is rotatably attached to one side of the oven body 1 to open and close the cooling chamber 4. A control panel 6 is provided on the front surface of the oven body 1 in front of the machine chamber 2.

A reference numeral 3*a* designates a latch, which is inserted into a recess 3*b* when the door 3 is closed and removed from the recess 3*b* when the door 3 is opened. A microswitch (not shown) inputs a door opening/closing sensing signal to control means (not shown) by the operation of the latch 3*a*. Accordingly, the control means recognizes the opening or closing of the door 3, and controls the operation of the magnetron to selectively stop the generation of high frequency waves and generate high frequency waves.

However, although a microwave oven is provided with a shield structure that is capable of preventing high frequency waves generated by a magnetron from leaking out of a cooking chamber, there are persons who have fears that the microwaves may be discharged from the cooking chamber. Some persons, such as housewives and children, avoid using the microwave ovens for fear of leakage of microwaves.

Meanwhile, in the conventional microwave oven, a lamp 7 is automatically turned on to illuminate the cooking chamber 4 when the door 3 is opened, while a lamp 7 is automatically turned off when the door 3 is closed. Accordingly, when the door is kept opened due to a user's carelessness, the lamp 7 is unnecessarily kept turned on, thereby wasting electric power.

SUMMARY OF THE INVENTION

Accordingly, the present invention has been made keeping in mind the above problems occurring in the conventional art, and an object of the present invention is to provide a microwave oven and method for controlling the same, which is capable of controlling the generation of high frequency waves according to the presence of a user in a sensing area, thereby eliminating a person's fear of the leakage of high frequency waves.

Another object of the present invention is to provide a microwave oven and method for controlling the same, which is capable of controlling the operation of the lamp of the microwave oven according to the presence of a user in the sensing area, thereby preventing electric power from being wasted by a user's carelessness.

In order to accomplish the above object, the present invention provides a microwave oven, the microwave oven being used to heat and cook food using high frequency waves generated by high frequency generating means provided in an oven body, comprising: body sensing means for detecting the presence of a user in a sensing area extended over a certain area in front of the oven body; first operating means for operating the high frequency generating means; and control means for controlling the first operating means to selectively start, stop and resume the operation of the high frequency wave generating means according to the presence of a user in the sensing area.

Preferably, the body sensing means is a non-contact optical sensor for detecting the presence of a user without contact with the user.

Preferably, the body sensing means is mounted on the oven body at a position such that it covers a desired sensing area.

Preferably, the body sensing means comprises an infrared sensor for detecting the presence of a user in the sensing area in such a way that infrared rays emitted from a light emitting element enter a light receiving element, and a signal processing unit for high-pass-filtering and amplifying infrared signals entering the light receiving element.

Preferably, the microwave oven further comprises a light guide member for widely diffusing emitted infrared rays over a sensing area and condensing refracted infrared rays.

Preferably, the light guide member consists of a wide-angle lens positioned in front of the light emitting element and a condensing lens positioned in front of the light receiving element.

Preferably, the microwave oven further comprises a lamp for illuminating the cooking chamber of the oven body, second operating means for operating the lamp, and door opening/closing means for detecting the opening and closing of the door, wherein the control means controls the second operating means to turn on or off the lamp according to the presence of a user in the sensing area while the door is closed.

Additionally, the present invention provides a method for controlling a microwave oven, the microwave oven being used to heat and cook food using high frequency waves generated by high frequency generating means provided in an oven body, comprising the steps of: a) controlling the operation of a lamp according to the presence of a user in a sensing area extended over a certain area in front of the oven body in a first operation mode of putting food into the oven body; b) controlling the operation of a magnetron according to the presence of a user in the sensing area in a second operation mode of performing a cooking operation for a predetermined cooking time period; and c) controlling the operation of the lamp according to the presence of a user in the sensing area in a third operation mode of taking out food from the oven body.

Preferably, the first and third operating modes each comprise the steps of: turning on the lamp if the user is present in the sensing area; and turning off the lamp if the user is not present in the sensing area.

Preferably, the second operation mode comprises the steps of: starting the magnetron if a user is not present in the sensing area; stopping the magnetron if a user is present in the sensing area; and resuming the operation of the magnetron if a user is not present in the sensing area before the cooking time period is terminated.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Hereinafter, a microwave oven and method for controlling the same in accordance with a preferred embodiment of the present invention is described in detail with reference to the accompanying drawings.

FIG. 1 is a perspective view showing a microwave oven in accordance with the present invention.

Figure 5:
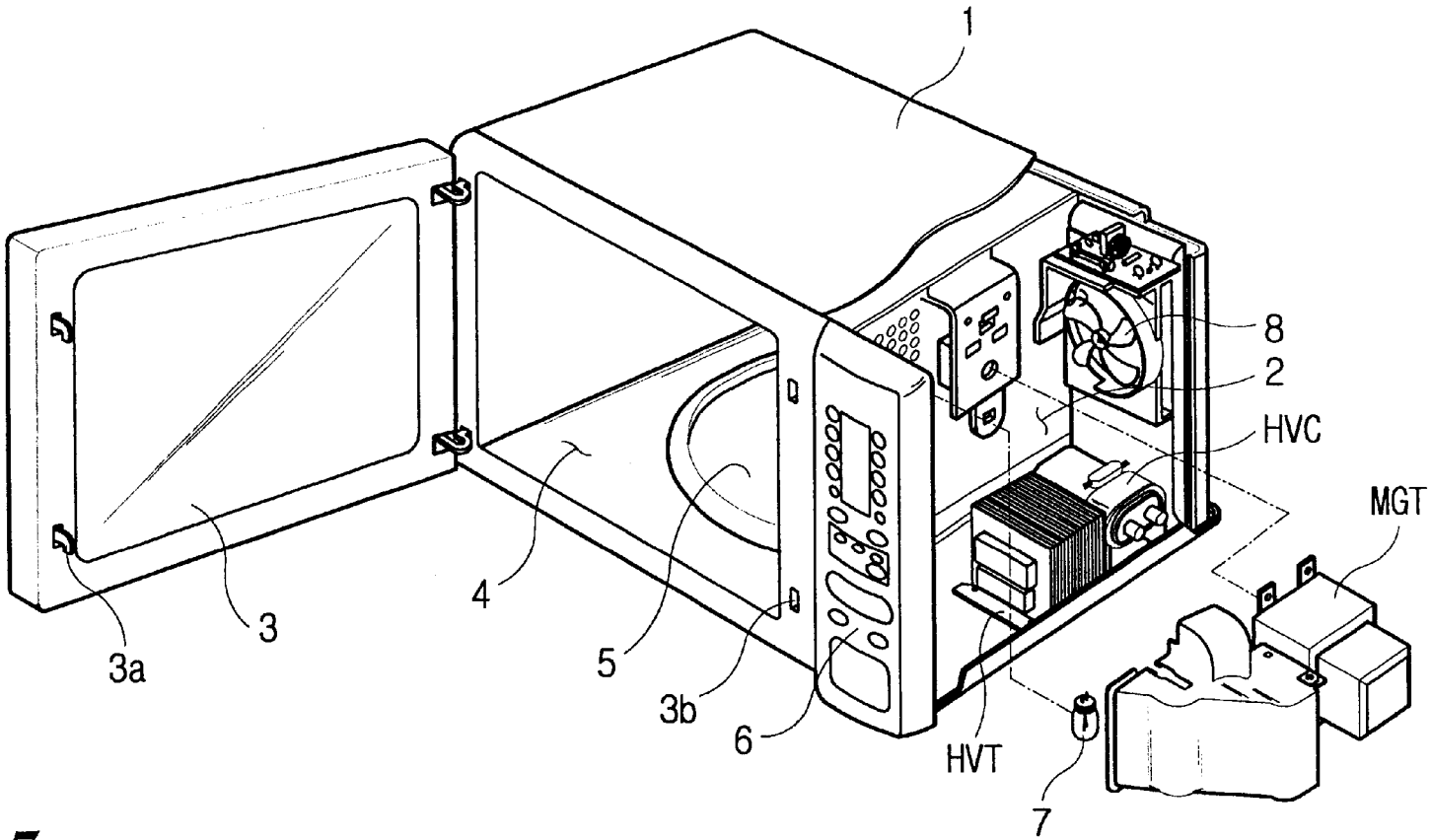
FIG. 5 is a perspective view of a conventional microwave oven.

The microwave oven of the present invention comprises the same component elements as a conventional microwave oven illustrated in FIG. 5 and, additionally, a body detecting sensor 13.

Figure 1A:
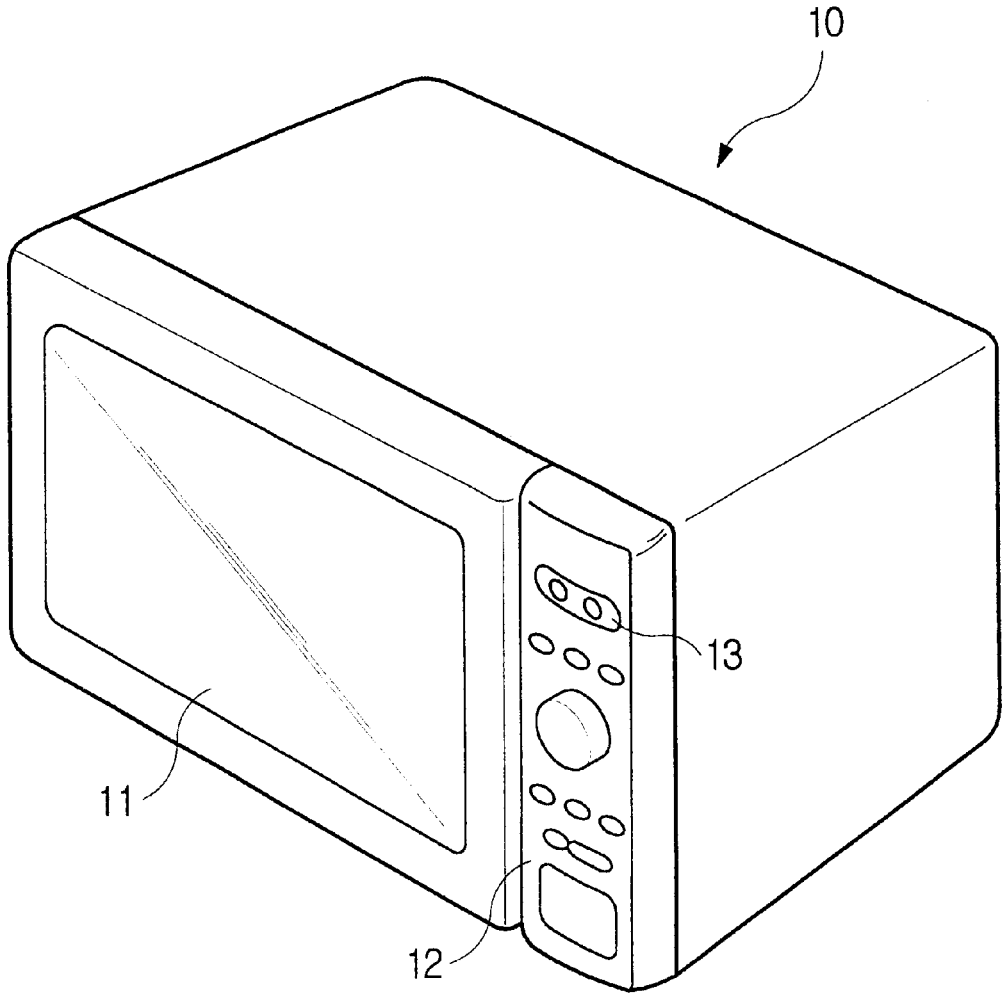
FIG. 1*a* is a perspective view showing a microwave oven in accordance with the present invention.

As shown in FIG. 1*a*, the body detecting sensor 13 is formed in a control panel 12 mounted on the front surface of the microwave oven of the present invention. The body detecting sensor 13 detects the presence of a user when a user approaches the microwave oven to open or close the door 11 of the microwave oven or to input cooking information, such as a cooking type and a cooking time period.

Figure 1B:
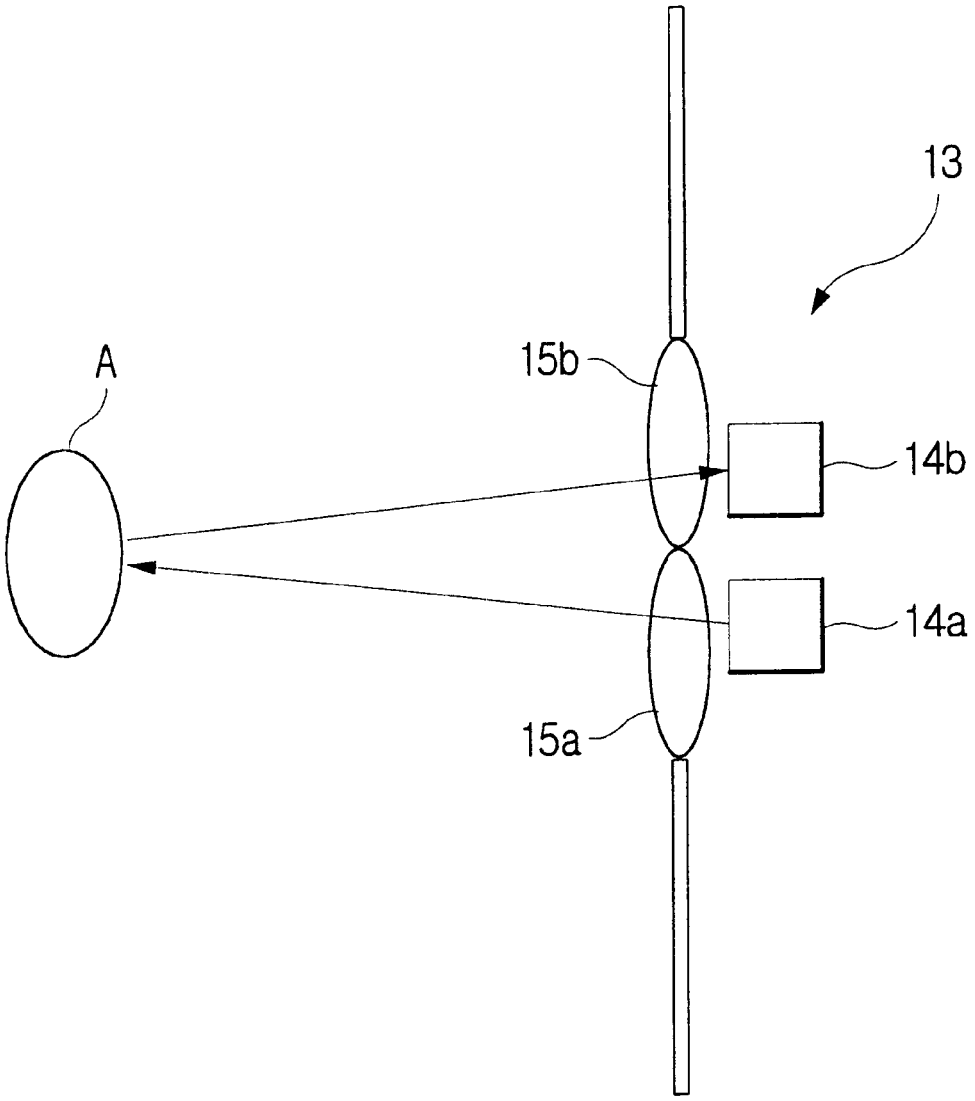
FIG. 1*b* is a horizontal sectional view showing the construction and operation of the body detecting sensor of the microwave oven.

The body detecting sensor 13, as shown in FIG. 1*b*, is comprised of a light emitting element 14*a* for emitting infrared rays in a forward direction from an oven body 10, a light receiving element 14*b* for receiving infrared rays reflected from a human body "A", and a light guide member 15*a* and 15*b* positioned in front of the light emitting and receiving elements 14*a* and 14*b* to guide infrared rays through a desired path. The light guide member 15*a* and 15*b* consists of a wide-angle lens 15*a* for widely diffusing infrared rays over a sensing area, and a condensing lens 15*b* for condensing infrared rays entering the light receiving element 14*b*.

Figure 2:
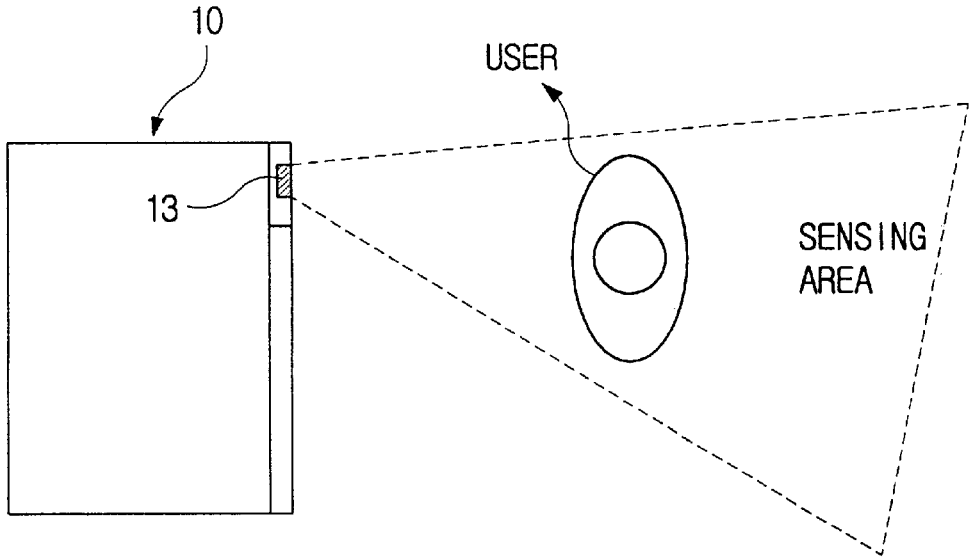
FIG. 2 is a view showing the sensing area of the body detecting sensor.

The body detecting sensor 13 is mounted on the oven body 10 at a position such that it covers a desired sensing area. Referring to FIG. 2, the body detecting sensor 13 is preferably located at a position where the body detecting sensor 13 detects a user entering a desired sensing area extended over a certain area in front of the oven body 10.

Figure 3:
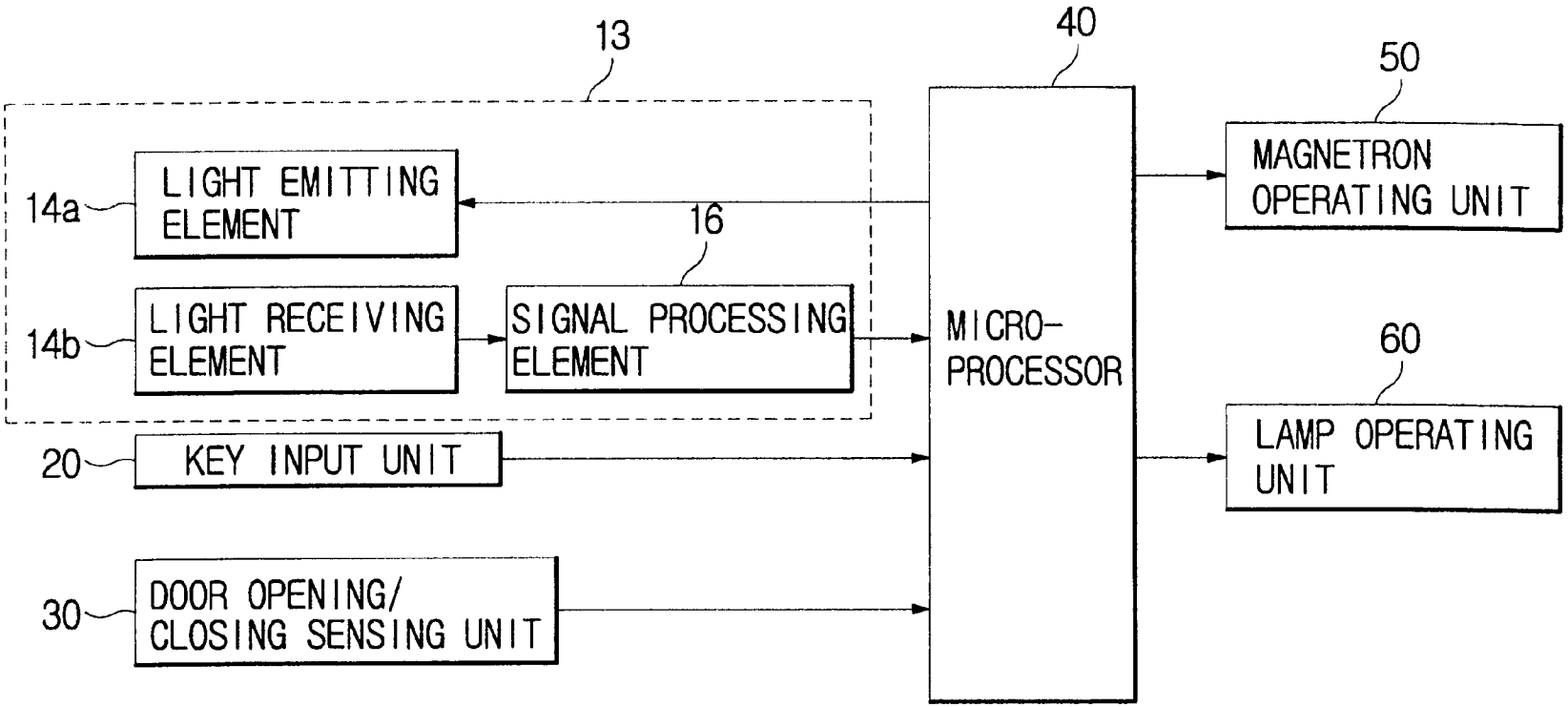
FIG. 3 is a block diagram of the microwave oven.

FIG. 3 is a block diagram of the microwave oven.

As shown in the drawing, the microwave oven of the present invention includes the body detecting sensor 13 connected to the input terminal of a microprocessor 40, a key input unit 20, a door opening/closing sensing unit 30, a magnetron operating unit 50 connected to the output terminal of the microprocessor 40 to operate the magnetron, and a lamp operating unit 60 connected to the output terminal of the microprocessor 40 to operate the lamp.

The body detecting sensor 13 of the present invention is comprised of the light emitting element 14*a* for diffusing infrared rays over a sensing area through a wide-angle lens 15*a*, the light receiving element 14*b* for receiving infrared rays reflected by the human body "A" and condensed by the condensing lens 15*b*, and a signal processing unit 16 for high-pass-filtering and amplifying infrared signals received through the light receiving element 14*b*. In detail, the signal processing unit 16 filters and amplifies the high frequency components of infrared rays and outputs them to the microprocessor 40 so as to detect the high frequency components of the infrared rays deflected from the human body, since external rays having a constant luminous intensity correspond to low frequency components.

The key input unit 20 is provided with a plurality of function keys for allowing a user to input cooking information such as a cooking type and a cooking time, and outputs the key signal corresponding to the key manipulated by the user to a microprocessor 40. The microprocessor 40 receives cooking information corresponding to the inputted key signal, and controls the cooking operation corresponding to the received cooking information.

The door opening/closing sensing unit 30 outputs a door-opening sensing signal generated by a microswitch (not shown) according to the opening and closing of the door 11, and the microprocessor 40 recognizes the opening and closing of the door 11 according to the door opening/closing sensing signals.

The magnetron operating unit 50 selectively generates high frequency waves and stops the generation of high frequency waves by selectively connecting the magnetron to an operating source and disconnecting the magnetron from the operating source according to the control signal of the microprocessor 40.

The lamp operating unit 60 selectively turns on and off the lamp of the microwave oven according to the control signal of the microprocessor 40.

When a user approaches the oven body 10 and opens the door 11 so as to put food into the microwave oven, the microprocessor 40 recognizes the approach of the user by means of the body detecting sensor 13 and the opening of the door 11 by means of the door opening/closing sensing unit 30, and outputs a control signal to the lamp operating unit 60 to turn on the lamp. Meanwhile, when the user retreats from the oven body 10 or closes the door 11, the microprocessor 40 recognizes the retreat of the user by means of the body detecting sensor 13 or the closing of door 11 by means of the door opening/closing of the door 11, and outputs a control signal to the lamp operating unit 60 to turn off the lamp. Accordingly, the lamp is turned on when a user is present in the sensing area and turned off when the user retreats from the sensing area, so the cooking chamber can be illuminated for a necessary time period.

When a user approaches the oven body 10 and opens the door 11 so as to take food out from the microwave oven, the microprocessor 40 controls the lamp to be turned on only while the user is present in the sensing area. As in the case where food is put into the microwave oven, the microprocessor 40 controls the lamp to be turned on when a user is present in the sensing area and to be turned off when the user retreats from the sensing area, so the cooking chamber can be illuminated for a necessary time period.

In the meantime, when a user inputs cooking information, such as a cooking type and a cooking time period, after putting food into the oven body 10 and closing the door 11, a cooking start signal is inputted to the microprocessor 40. In this case, if the user is not present in the sensing, area, that is, the user having completed the input of the cooking information retreats from the sensing area, the microprocessor 40 outputs a control signal to the magnetron operating unit 50 to cook food by generating high frequency waves.

When a user approaches the oven body 10 while the magnetron is operated, the microprocessor 40 recognizes the entrance of the user to the sensing area by means of the body detecting sensor 13, and outputs a control signal to the magnetron operating unit 50 to stop the magnetron, thereby stopping the generation of high frequency waves. Thereafter, when the user retreats from the sensing area, the microprocessor 40 outputs a control signal to the magnetron operating unit 50 to re-start magnetron, thereby resuming the generation of high frequency waves. As described above, the operation in which the generation of high frequency waves is selectively stopped and resumed according to the approach to the sensing area and retreat of the user from the sensing area can be performed until the cooking operation of food is completed, so a user's fear of the leakage of high frequency waves can be eliminated.

Figure 4:
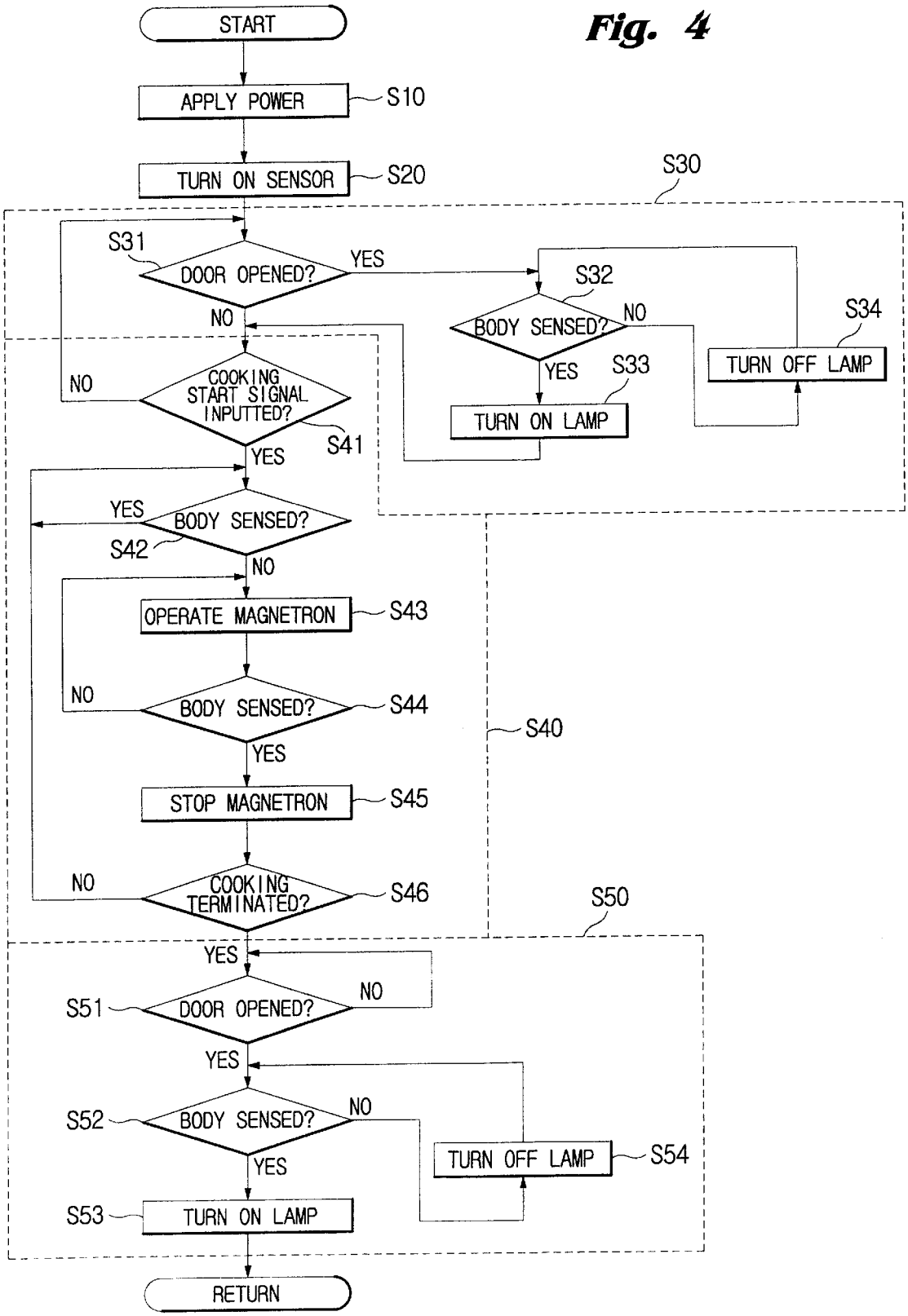
FIG. 4 is a flowchart showing a method for controlling the microwave oven in accordance with the present invention.

Hereinafter, the method for controlling the microwave oven is described with reference to FIG. 4.

First of all, when electric power is applied to the microwave oven through an electric plug (S 10), the body detecting sensor 13 is activated (S20), so infrared rays are emitted from the light emitting element 14*a* to the sensing area situated in front of the oven body 10.

Subsequently, the microprocessor 40 performs a first operating mode in which the lamp is turned on while the door 11 is opened and the user is present in the sensing area (S30). In more detail, the microprocessor 40 determines whether the door 11 is opened according to a door opening/closing signal from the door opening/closing detecting sensor 30 (S31). If the door 11 is opened, it is determined whether the user is present in the sensing area (S32). If the user is present in the sensing area, the microprocessor 40 outputs a control signal to the lamp operating unit 60 to turn on the lamp (S33). If the user is not present in the sensing area, the microprocessor 40 regards the lamp as being abandoned and outputs a control signal to the lamp operating unit 60 to turn off the lamp (S34) and the procedure returns to the step S32 to keep the lamp turned off until a user approaches the oven body 10 (S32).

When the cooking information is inputted at the step S30 and the cooking start signal is inputted, the microprocessor 40 performs a second operation mode in which the magnetron is operated to generate high frequency waves and, thereby, cook food only when a user retreats from the sensing area (S40).

In more detail, when the lamp is turned on at the step S33, it is determined whether the cooking start signal is inputted from the key input unit 20 (S41). This is because the cooking start signal is inputted after a user closes the door, puts food into the oven body 10, and inputs cooking information including a cooking type and a cooking time period. If the cooking start signal is not inputted, the microprocessor 40 regards food as being not put into the oven body 10 and, therefore, the procedure returns to the step 31.

If the cooking start signal is inputted, that is, the input of cooking information is completed while the door 11 is closed, the microprocessor 40 determines whether a user is present in the sensing area using the body detecting sensor 13 (S42). If a user is present in the sensing area, the microprocessor 13 is on standby. If a user is not present in the sensing area, the microprocessor 40 outputs a control signal to the magnetron operating unit 50. As a result, operating power is applied to the magnetron, the magnetron generates high frequency waves, and a cooking operation is performed (S43).

While the microwave oven performs the cooking operation, it is determined whether a user is present in the sensing area using the body detecting sensor 13 (S44). If a user is not present in the sensing area, that is, a user does not approach the oven body 10, the procedure returns to the step S43 to keep the magnetron operated. If a user is present in the sensing area, that is, a user approaches the oven body 10, the microprocessor 40 outputs a control signal to the magnetron operating unit 50 to stop the operation of the magnetron, thereby stopping the generation of high frequency waves (S45).

Subsequently, the microprocessor 40 determines whether the cooking time period set at the cooking information inputting step is terminated (S46). If the cooking time period is not terminated, the procedure returns to the step S42 so as to resume the cooking operation by re-start the magnetron after the user retreats from the microwave oven 10.

If the cooking time period is terminated, there is performed a third operation mode S50 in which the lamp is turned on only when a user enters the sensing area to take cooked food out from the microwave oven. That is, like the first operation mode S30, the lamp is turned on only when the door is opened and a user is present in the sensing area (S51, S52 and S53).

If the door is closed, the microprocessor 40 is on standby. Even if the door is opened, the lamp is turned off if the user retreats from the sensing area (S51, S52 and S54).

As described above, the present invention provides a microwave oven and method for controlling the same, which is capable of performing its cooking operation while a user is not present in a sensing area, thereby eliminating a user's fear of the leakage of high frequency waves.

Additionally, the present invention provides a microwave oven and method for controlling the same, which is capable of turning on its lamp while a user is present in a sensing area, thereby preventing electric power from being wasted by a user's carelessness.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, said microwave oven being used to heat and cook food using high frequency waves generated by high frequency generating means provided in an oven body, comprising:

body sensing means for detecting the presence of a user in a sensing area extended over a certain area in front of the oven body;

first operating means for operating the high frequency generating means; and control means for controlling the first operating means to selectively start, stop and resume the operation of the high frequency wave generating means according to the presence of a user in the sensing area.

2. The microwave oven according to claim 1, wherein said body sensing means is a non-contact optical sensor for detecting the presence of a user without contact with the user.

3. The microwave oven according to claim 2, wherein said body sensing means comprises an infrared sensor for detecting the presence of a user in the sensing area in such a way that infrared rays emitted from a light emitting element enter a light receiving element, and a signal processing unit for high-pass-filtering and amplifying infrared signals entering the light receiving element.

4. The microwave oven according to claim 3, further comprising a light guide member for widely diffusing emitted infrared rays over a sensing area and condensing refracted infrared rays.

5. The microwave oven according to claim 4, wherein said light guide member consists of a wide-angle lens positioned in front of the light emitting element and a condensing lens positioned in front of the light receiving element.

6. The microwave oven according to claim 1, wherein said body sensing means is mounted on the oven body at a position such that it covers a desired sensing area.

7. The microwave oven according to claim 1, further comprising a lamp for illuminating the cooking chamber of the oven body, second operating means for operating the lamp, and door opening/closing means for detecting the opening and closing of the door, wherein said control means controls the second operating means to turn on or off the lamp according to the presence of a user in the sensing area while the door is closed.

8. A method for controlling a microwave oven, said microwave oven being used to heat and cook food using high frequency waves generated by high frequency generating means provided in an oven body, comprising the steps of:

a) controlling the operation of a lamp according to the presence of a user in a sensing area extended over a certain area in front of the oven body in a first operation mode of putting food into the oven body;

b) controlling the operation of a magnetron according to the presence of a user in the sensing area in a second operation mode of performing a cooking operation for a predetermined cooking time period; and c) controlling the operation of the lamp according to the presence of a user in the sensing area in a third operation mode of taking out food from the oven body.

9. The method according to claim 8, wherein said first and third operating modes each comprise the steps of:

turning on the lamp if the user is present in the sensing area; and turning off the lamp if the user is not present in the sensing area.

10. A method for controlling a microwave oven, comprising the steps of:

controlling the operation of a lamp illuminating the food within an interior of the oven body, in dependence upon the presence of a user in a sensing are extended over a certain area in front of the oven body in a first operational mode of putting food into the oven body;

controlling the operation of a magnetron according to the presence of a user in the sensing area in a second operational mode of performing a cooking operation for a predetermined cooking time period by:

providing said magnetron to heat and cook food by using high frequency waves generated by a magnetron;

starting the magnetron if a user is not present in the sensing area;

stopping the magnetron if a user is present in the sensing area; and resuming the operation of the magnetron if a user is not present in the sensing area before the cooking time period is terminated; and controlling the operation of the lamp according to the presence of a user in the sensing area in a third operational mode of taking out food from the oven body.

* * * * *